United States Patent [19]

Hotomi

[11] Patent Number: 4,962,723

[45] Date of Patent: Oct. 16, 1990

[54] IMAGE FORMING APPARATUS UTILIZING PLURAL ELECTRIC FIELD GENERATING APPANGEMENTS SO AS TO DEPOSIT DEVELOPER PARTICLES SUPPLIED FROM A DEVELOPER CHAMBER

[75] Inventor: Hideo Hotomi, Osaka, Japan

[73] Assignee: Minolta Camera Kabushiki Kaisha, Osaka, Japan

[21] Appl. No.: 294,128

[22] Filed: Jan. 6, 1989

[30] Foreign Application Priority Data

Jan. 8, 1988 [JP] Japan ..... 63-2775

[51] Int. Cl.[5] ..... G03G 15/08

[52] U.S. Cl. ..... 118/654; 118/679; 355/247; 355/249; 361/227

[58] Field of Search ..... 118/654, 679; 355/247, 355/249; 430/102, 120

[56] References Cited

U.S. PATENT DOCUMENTS

| | | | |
|---|---|---|---|
| 3,962,992 | 6/1976 | Takegi et al. | 118/654 |
| 4,431,296 | 2/1984 | Haneda et al. | 118/654 X |
| 4,450,220 | 5/1984 | Haneda et al. | 355/249 X |
| 4,527,884 | 7/1985 | Nusser | 355/249 |
| 4,792,512 | 12/1988 | Haneda et al. . | |

FOREIGN PATENT DOCUMENTS

| | | |
|---|---|---|
| 47-47811 | 12/1972 | Japan . |
| 54-12667 | 5/1979 | Japan . |
| 61-189565 | 8/1986 | Japan . |

*Primary Examiner*—R. L. Moses

*Attorney, Agent, or Firm*—Burns, Doane, Swecker & Mathis

[57] ABSTRACT

An image forming apparatus for forming a developing powder image onto a recording medium comprising, a chamber for accommodating a developing powder and having an opening confronting the recording medium, first electric field generating device for generating an electric field curtain force in the chamber so as to suspend the developing powder in a cloud and second electric field generating device provided in the vicinity of the opening wherein the suspended developing powder is selectively move the recording medium according to an image signal or an electrostatic latent image.

10 Claims, 9 Drawing Sheets

IMAGE FORMING APPARATUS UTILIZING PLURAL ELECTRIC FIELD GENERATING APPANGEMENTS SO AS TO DEPOSIT DEVELOPER PARTICLES SUPPLIED FROM A DEVELOPER CHAMBER

BACKGROUND OF THE INVENTION

The present invention relates to a developing apparatus for forming images on a recording medium using powder developer. More specifically, the present invention relates to a compact, high-resolution; high-speed recording developing apparatus suitable for the electrostatic recording device used in electrostatic copy machines, electrostatic printers, electrostatic facsimiles, electrostatic plotters and the like.

The aforesaid electrostatic recording apparatus forms a developer image by electrostatically adhering a powder developer on a recording member such as a photosensitive member, dielectric member or the like, and has found wide application. More specifically, the powder developer may be a bicomponent developer comprising toner particles and carrier particles, or a monocomponent developer comprising only toner particles. Conventional recording devices are practical for utilization in a variety of fields such as, for example, facsimile printers used as output devices for optical communications and computers, but higher performance is desirable due to the current demands of society.

One of these demands is for down-sizing the entire unit into a more compact package. A further demand is for higher density recording images, necessitating improved resolution. Another demand is for higher speed recording.

While down-sizing the entire device is desirable from many perspectives, a developing apparatus adapted for use in conventional electrostatic recording devices agitates and mixes the toner and carrier powders through a mechanically applied external force so as to triboelectrically charge the powders with an electrostatic charge, thus requiring a drive unit for the agitation of the powders which has the inherent disadvantage of preventing down-sizing of the unit beyond a certain degree.

Improvement of the resolution of the recording image, i.e. the developer image on the recording medium, is especially important for recent design utilizing computer capabilities and computer-aided design (CAD) system output devices and the like.

Conventional developing apparatuses, however, use developer which is triboelectrically charged through a mechanically applied external force, as previously described. In concrete terms, a problem arises when the developer is mixed by an agitator or sleeve or the like, in that the toner particles in said developer continually agglomerate and disperse, or the toner particles adhere to carrier particles and the developer cannot achieve the anticipated characteristics.

Further, although it is known that adequate triboelectric charging uniformly charges the developer so as to effectively prevent blurring of the recording image, uniform charging of conventional developers is difficult to accomplish. That is, as the amount of mechanically applied external force used to induce triboelectric charging is increased, the developer loses stress resistance making the, previously described developer agglomeration more probable and leading to disadvantages such as developer particles being randomly dispersed to inappropriate portions of the recording medium.

There have been various approaches to improving image resolution, one of which is the use of small diameter developer particles. That is, extremely small particles having diameters ranging from several μm to 10 μm are used in image formation to improve fine line reproducibility in particular. However, particles of that size have certain drawbacks in that small diameter particles have poor flow characteristics, are difficult to charge triboelectrically due to the difficulty in mixing such particles, and are randomly dispersed outside the target areas, thereby preventing the formation of a high quality developer image.

Further, capsule toner is another well known type of developer Capsule toner comprises an ink component and resin component to achieve permanent fusion of the developer on an appropriate recording medium, but such components are too readily susceptible to fusion and agglomeration and have inherent disadvantages such as the lack of capsule durability due to stress caused by charging via mechanical external force, and damage to said capsule which leads to fusion and agglomeration of the developer.

The demand for high-speed recording has also increased in recent years. To accomplish high-speed recording, it is necessary to increase the volume of developer supplied per unit time. However, certain disadvantages, such as developer scattering, accompany this increase in developer volume deliver.

SUMMARY OF THE INVENTION

Accordingly, an object of the present invention is to provide a simply constructed and extremely compact developing apparatus.

Another object of the present invention is to provide a developing apparatus which produces excellent high-resolution developer images.

Another object of the present invention is to provide a developing apparatus which does not cause developer spattering.

A further object of the present invention is to provide a developing apparatus that produces sufficient triboelectric charging of the developer so that the developer is adequately charged.

A still further object of the present invention is to provide a developing apparatus suitable for use with a developer having extremely small-diameter developer particles.

An even further object of the present invention is to provide a developing apparatus suitable for use with capsule toner.

A still further object of the present invention is to provide a developing apparatus which prevents random spattering of the developer to inappropriate regions on the recording medium to thereby produce clean images.

An even further object of the present invention is to provide a developing apparatus suitable for high-speed recording.

Another object of the present invention is to provide a developing apparatus of simple construction which is capable of triboelectrically charging each developer particle completely without the application of mechanical external force to the developer particles, prevents agglomeration between the particles, supplies a liberal volume of developer per unit time, and prevents random spattering of the developer to inappropriate portions of the recording medium.

More specifically, the present invention relates to a developing apparatus for forming developer images by depositing developer particles onto the surface of a recording medium, said developing apparatus comprising:

a developing chamber for receiving the aforesaid developer particles and which is provided with an opening in the surface opposite the recording medium;

a first electrical field generating means for generating an electrical field curtain to suspend the aforesaid developer particles in a cloud, said first generating means being provided on at least one internal wall of said developing device;

and a second electrical field curtain generating means for generating an electrical field curtain to selectively move said developer particles on the surface of the aforesaid recording medium, said second generating means being provided near the aforesaid opening in the developing chamber.

BRIEF DESCRIPTION OF THE DRAWINGS

These and other objects or features of the present invention will become apparent from the following description of a preferred embodiment(s) thereof taken in conjunction with the accompanying drawings, in which.

In the following description, like parts are designated by like reference numbers throughout the several drawings.

DESCRIPTION OF THE PREFERRED EMBODIMENTS

First Embodiment

Figure 1:
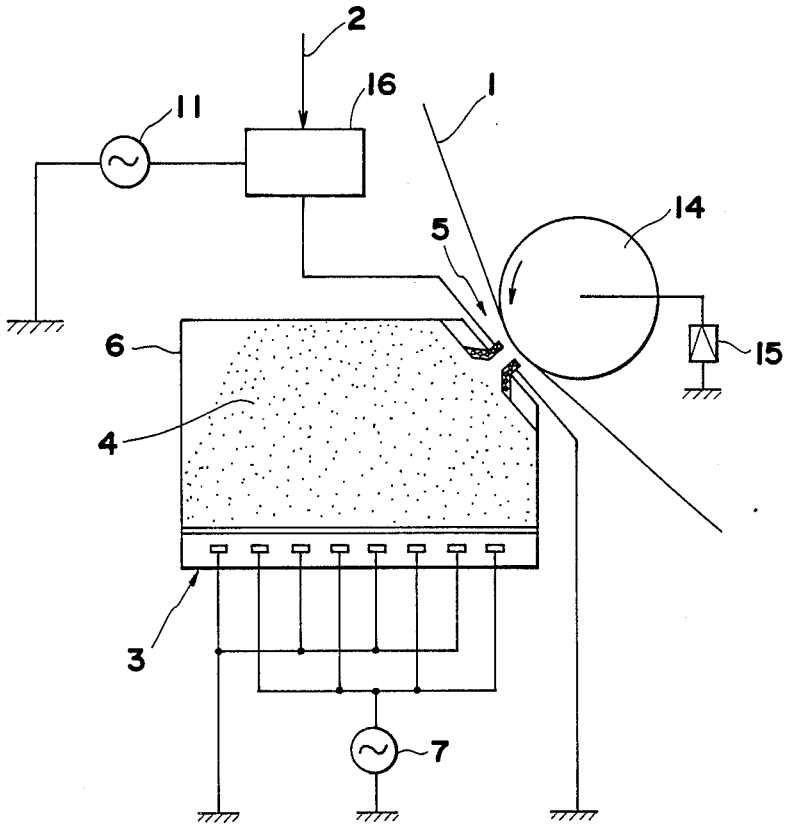
FIG. 1 is a side elevation view showing a schematic view of a portion of the developing apparatus of the present invention in cross section.

FIG. 1 shows a developing apparatus of the present invention used in an electrostatic printer.

In the drawing, item 1 is normal paper used as the recording medium, item 2 is an image signal required to form the image on the recording medium, item 3 is first electrical field curtain generating means, item 4 is negatively-charged, non-magnetic monocomponent developer (toner) produced from polyester resin and having a particle diameter of 5.5 μm. Also in the drawing, item 5 is a second electric field curtain generating means provided at the slit-shaped opening of developing chamber 6 which is formed of acrylic resin.

Figure 2:
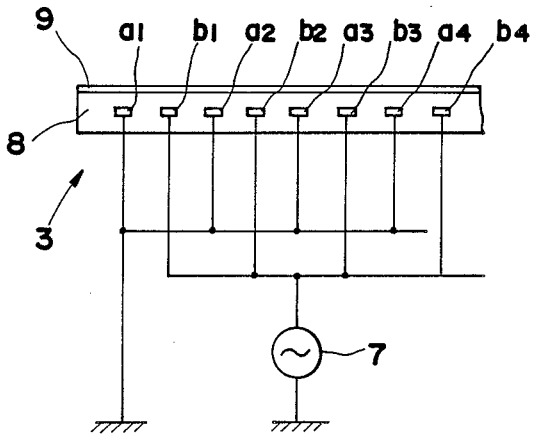
FIG. 2 is an enlarged partial section view showing the first electrical field curtain generating means of the apparatus shown in FIG. 1.

FIG. 2 shows details of the first electric field curtain generating means 3 in FIG. 1. First electric field curtain generating means 3 is disposed beneath sheet member 8 and comprises a plurality of grounded line electrodes a1 to a4 and a plurality of secondary line electrodes b1 to b4 also disposed beneath the same sheet member 8 and which are connected to an alternating current (AC) power source 7. The surface of the aforesaid sheet member 8 has a surface member affixed thereto, said surface member comprising a material having a superior ability to contact charge the aforesaid toner. Of course, developing chamber 6 is formed of the same material as surface member 9 so as to increase toner chargebility.

First and second line electrodes are copper line electrodes having a width of 1 mm, and the space between said first and second line electrodes is 2 mm. AC power source 7 supplies power at a voltage of 3 KV and a frequency of 1 kHz. Any conductive material may be used for the electrodes, for example, Au, Al, Cr, Ni, Fe or alloys thereof, ITO glass, carbon electrodes or the like. Polyamide resin is selected as the material for sheet member 8 having a thickness of 1 mm, and polyester resin is selected for surface member 9 having a thickness of 50 μm. The device shown in FIG. 2 is only a single embodiment, and in the present embodiment the line electrodes are copper line electrodes arranged in parallel configuration, however, the cross section configuration of said line electrodes may be otherwise optionally arranged, and a grid-like ( or net-like) configuration may be substituted for said line electrodes. In addition, it is desirable that the material of surface member 9 be suitably optimized for the developer used. For example, when the toner particles in the developer (both carrier and toner particles in the case of bicomponent developer, and toner alone in the case of monocomponent developer) are to be positively charged, it is desirable that nigrosine oiliness dye, crystal violet or other basic dye, azine dye, lake pigment, or tetra ammonium salt is incorporated in a suitable substrate resin in surface member 9 at 2 to 20% by weight. When the toner particles are to be negatively charged, it is desirable that a metallic complex of monoazo dye, metallic complex of palatine dye or the like, salicylic acid naphthoic acid or other metallic oxide of Co, Cr, Fe or the like, melamine resin or any of various metallic oxides is similarly incorporated in a suitable substrate resin at 2 to 20% by weight.

It is further desirable that an internal wall within developing chamber 6 be formed of the same material as described above for surface member 9. Essentially, it is desirable from the standpoint of preventing developer splatter that the material possess a triboelectrificational character such that the developer can be charged with the desired polarity.

Figure 3:
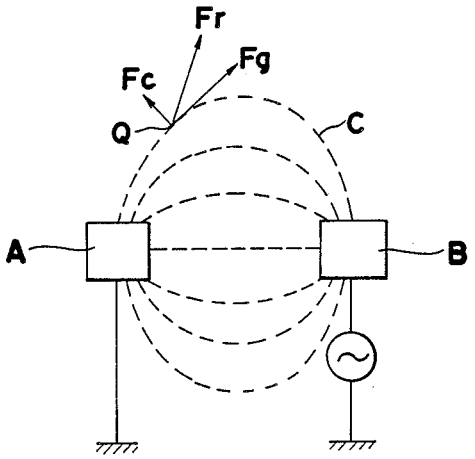
FIG. 3 is an illustrative diagram to explain the operation of the first electrical field curtain generating means.

Developer 4 is charged by the previously described first electrostatic curtain generating means 3 and suspended in a cloud-like state. A brief account of this process is described hereinafter. FIG. 3 shows a model of adjacent electrodes of the first electrostatic curtain generating means 3 shown in FIG. 1.

Charged toner particles Q are oscillated between points A and B along a curved line of electric force line C. Particles Q are acted upon by a strong repulsive force in the electric field direction from the electrode near point A, and a mean repulsive force Fg in a tangential direction to said line of electrical force C. The particles Q are then acted upon by the combined repulsive force Fr, which is the resultant force of Fc and Fg, so as to be moved further distant from the electrodes. Thus, particles Q begin to be suspended. The suspended particles Q come into contact with each other or come into contact with the internal wall of the developing device, so that the charge of all the particles Q is stably increased, and the suspended charged particles within the developing device are therefore suspended in a cloud-like state (particle flow state).

Figure 4:
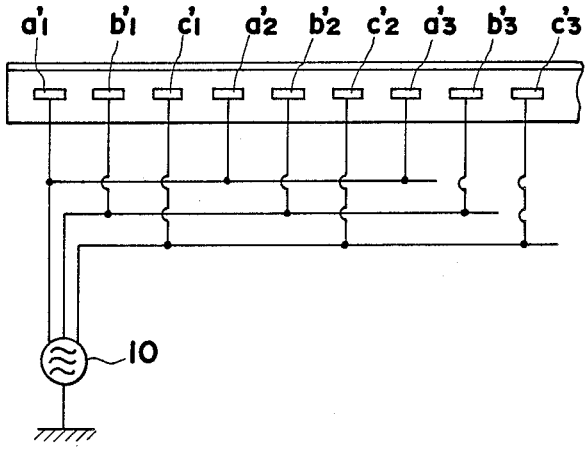
FIG. 4 is an enlarged partial section view of the modified modes of the apparatus shown in FIG. 1.

Further, the first electrostatic curtain generating means may be connected to a three-phase AC pow,.er source, as shown in FIG. 4. In the drawing, a'i, b'i and c'i are vertical (to the paper surface) linear electrodes to which are respectively applied phase-shifted alternating current from three-phase AC power source 10. The developer particles are not only suspended by the polyphase AC power source, but also undergo convective movement so as to be effectively charged and suspended. That is, the phase shift acts on the developer particles as a progressive wave because the shift-phased AC voltage accumulates on the developer particles, and since this occurs as said developer particles oscillate in a uniform direction convection is produced within the cloud.

It is obvious that the impression of an AC voltage of two or more phases is advantageous in producing the aforesaid convective movement, and that a polyphase AC current, which is not limited to three-phase current, may also be employed.

Also, whether single or polyphase, a suitable AC wave for the first electrostatic curtain generating means will be produced with a voltage of 100 V to 5 kV at a frequency of from 100 Hz to 10 kHz.

The developer in a cloud-like state is confined or released by means of the second electrostatic curtain generating means 5, and forms a toner image on the recording medium when released by said generating means.

Figure 5:
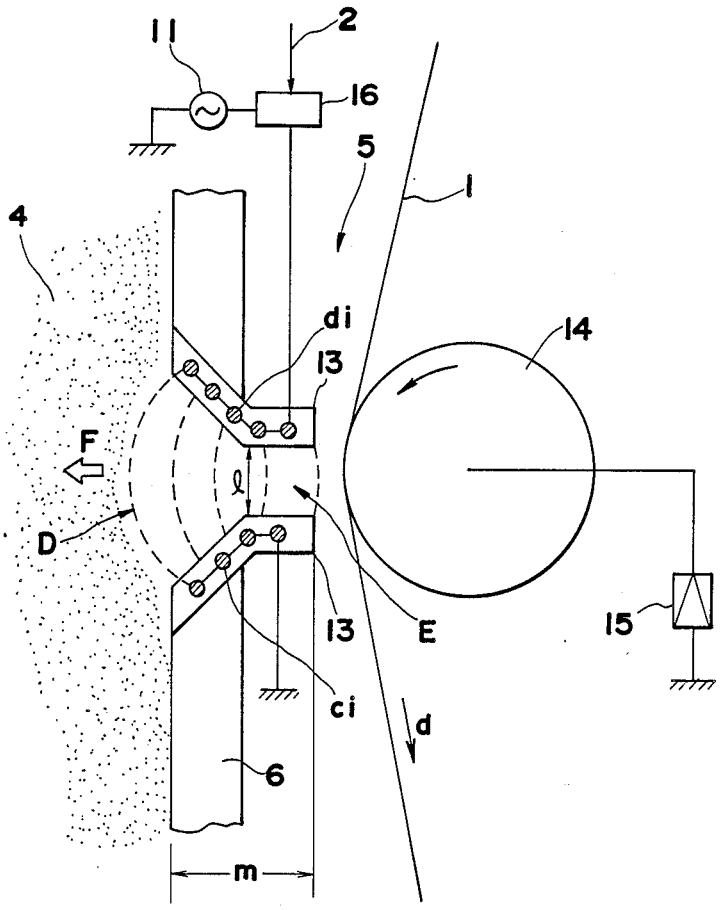
FIG. 5 is an enlarged partial section view illustrating the operation of the second electrical field curtain generating means of the device shown in FIG. 1.

FIG. 5 shows details of the second electrostatic curtain generating means 5 shown in FIG. 1. Second electrostatic curtain generating means 5 comprises a plurality of individual primary electrodes ci arranged orthoganally (i.e., vertically relative to the surface of the drawing) to the transport direction of recording medium 1, and secondary electrodes "di" arranged opposite said primary electrodes ci with slit opening E disposed therebetween. FIG. 5 is a cross sectional view of one of the generating means, said generating means having a fixed number of electrodes arranged orthogonally to the transport direction of the recording medium 1.

More specifically, first electrodes ci are disposed beneath slit member 13 which is comprised of polyamide resin, and grounded. Secondary electrodes di are also disposed beneath the same slit member 13 and are connected to an AC power source through gate circuit 16 which is in turn connected to a host computer not shown in the drawing. The space (developing gap) between recording medium 1 and slit member 13 is 500 m, slit width "l" of slit member 13 is 300 μm, and width "m" of slit member 13 is 1.5 mm. AC power source 11 operates at a voltage of 250 V with a frequency of 1 kHz.

A bias roller 14 is disposed relative to the aforesaid second electrostatic curtain generating means so as to have the recording medium 1 travel therebetween. Bias roller 14 has impressed thereto a DC voltage of 450 V produced by DC power source 15.

Figure 6:
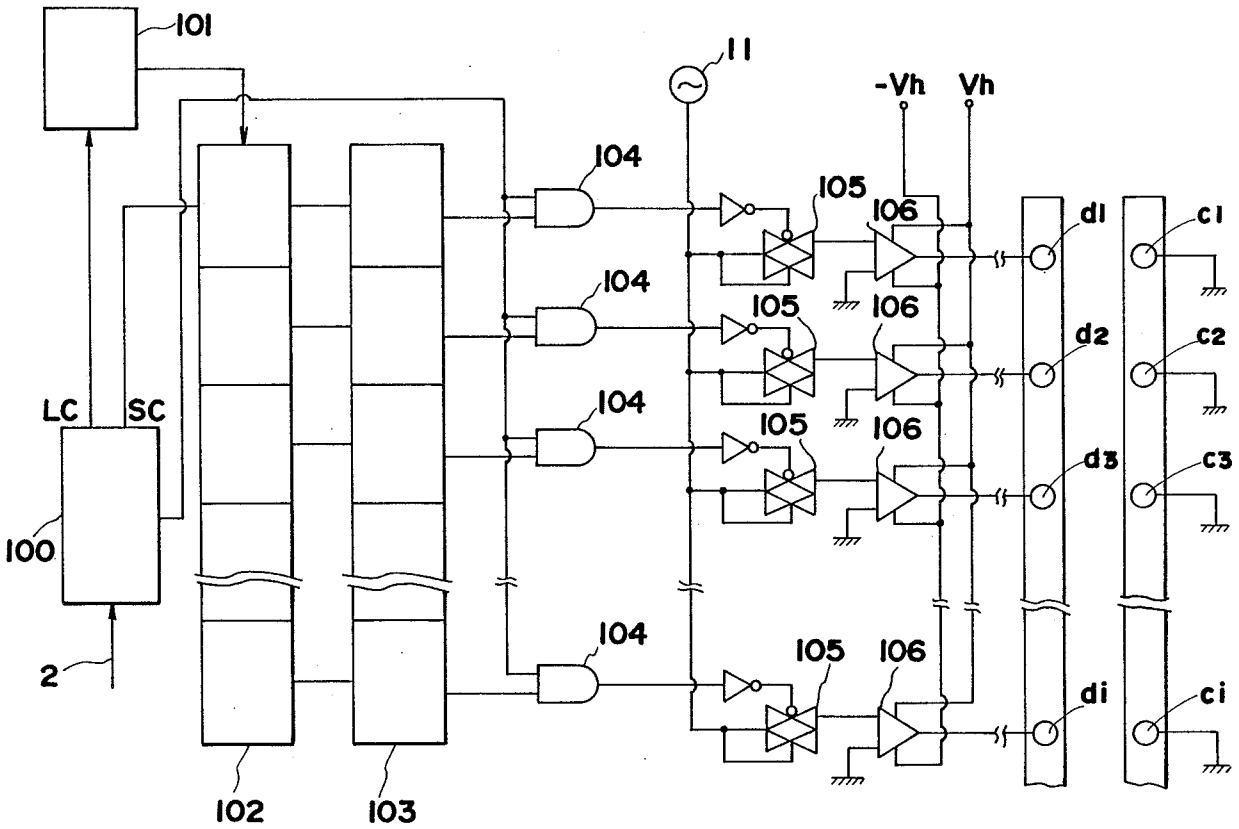
FIG. 6 is a schematic view of the circuits that can be used with the apparatus shown in FIG. 1.

A description of the process whereby a developer image is actually formed on recording medium 1 follows hereinafter. FIG. 6 is a circuit diagram of the interior of gate circuit 16.

The present embodiment is a line printer type which forms a single line of the entire developer image in the perpendicular direction relative to the transport direction of recording medium 1, and subsequently forms new single lines of the developer image in correspondence to the transport of said recording medium 1. The present invention, however, is obviously adaptable to serial printers and other printer types.

Recording data 2 input from a host computer or the like (not shown in the drawing) is processed in control circuit 100 using separate electrodes, is output as digital signals containing the gradation data for each picture element, and converted to analog signals by D/A transducer 101. The aforesaid analog signals are sequentially transmitted to analog shift register 102 synchronously with a shift clock (SC) so as to retain a single line of analog image signals in said shift register 102 The single line of analog image signals in shift register 102 is output in picture element units, and input to transducer 103 wherein it is converted into time-width pulse data corresponding to a voltage. Then for each individual AND gate 104, a line signal LC passes from control circuit 100 and becomes label "H" in the single line recording, and the required devices are actuated in accordance with the pulse data from transducer 103 through the individual analog switches 105 and amplifiers 106 disposed between AC voltage 11 and a plurality of electrodes "di." A recording AC voltage is then applied to the corresponding electrodes "di" for the time-width duration of the individual pulse data.

Figure 7:
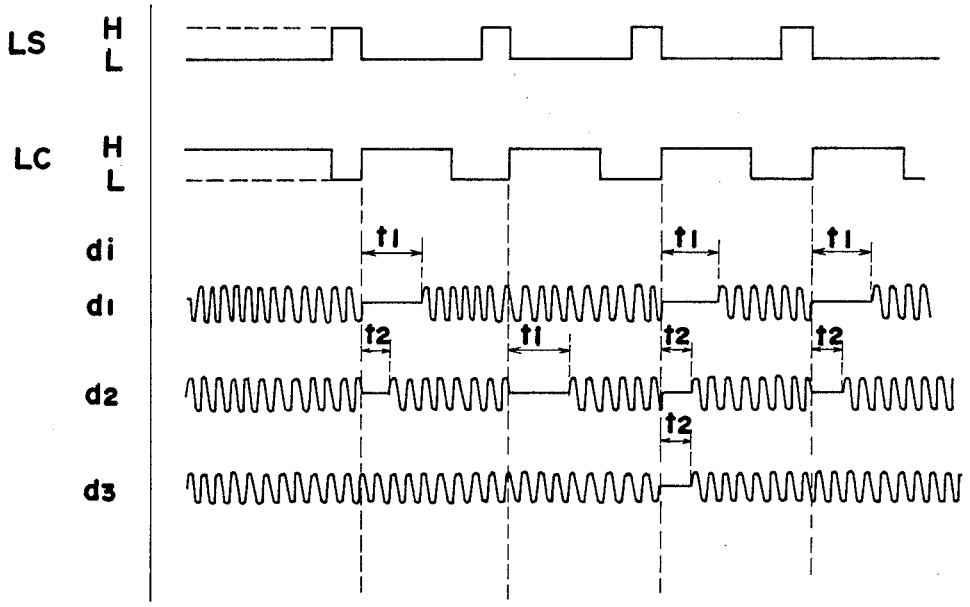
FIG. 7 is a time chart illustrating the image formation process of the apparatus shown in FIG. 1.

The timing of the AC voltage impression to the aforesaid electrodes "di" is shown in the timing chart of FIG. 7. In the chart, the horizontal direction shows the time variation, i.e., the in the voltage impressed to each electrode di, and the vertical direction shows the single line voltage impression state at a particular moment.

Although the developer image formed by opposing electrodes ci and "di" forms a single picture element in the present embodiment, a single picture element may be formed by several developer dots using, for example, a dither method or the like.

In the timing chart shown in FIG. 7, when an AC voltage is not applied to electrodes "di," an electrical field is generated by a bias voltage of +450 V, which is opposite in polarity to that of the toner, applied to bias roller 14 disposed opposite slit E with recording medium 1 arranged therebetween, and a portion of the suspended cloud of toner 4 is released form said cloud so as to form a single dot on the recording medium 1 by being electrostatically attracted thereto via the resultant Coulomb force.

The gradation of the aforesaid dot is determined by the length of time during which the AC voltage is not applied. That is, in FIG. 7, the dot is reproduced more densely the longer the AC voltage is OFF. Thus, the force during t1 reproduces a more dense gradation than does that of t2.

On the other hand, in the timing chart, when an AC voltage is applied to electrodes "di," i.e., when an AC voltage of 250 V and a frequency of 2 kHz is supplied by the AC power source, an electrostatic curtain is generated between the primary electrodes ci and secondary electrodes "di." Therefore, as shown in FIG. 5, toner in the region of slit member 13 is acted upon by a repulsive force from electric field D and repulsed through slit E toward the outer region F. The suspended toner cloud is confined in developing chamber 6 so as to prevent toner from spattering on the recording medium 1, and dot formation on the recording medium cannot be accomplished.

Although gradation reproduction can be accomplished by controlling the time of AC impression, it may also be accomplished by controlling the impressed voltage while maintaining the same impression time. That is, developer splatter toward the recording medium is controlled by relaxing the confinement of the cloud which is accomplished before by reducing the impressed voltage (reducing the AC amplitude), or confining the cloud by increasing the impressed voltage (increasing the AC amplitude), thereby accomplishing gradation reproduction.

Second Embodiment

Figure 8:
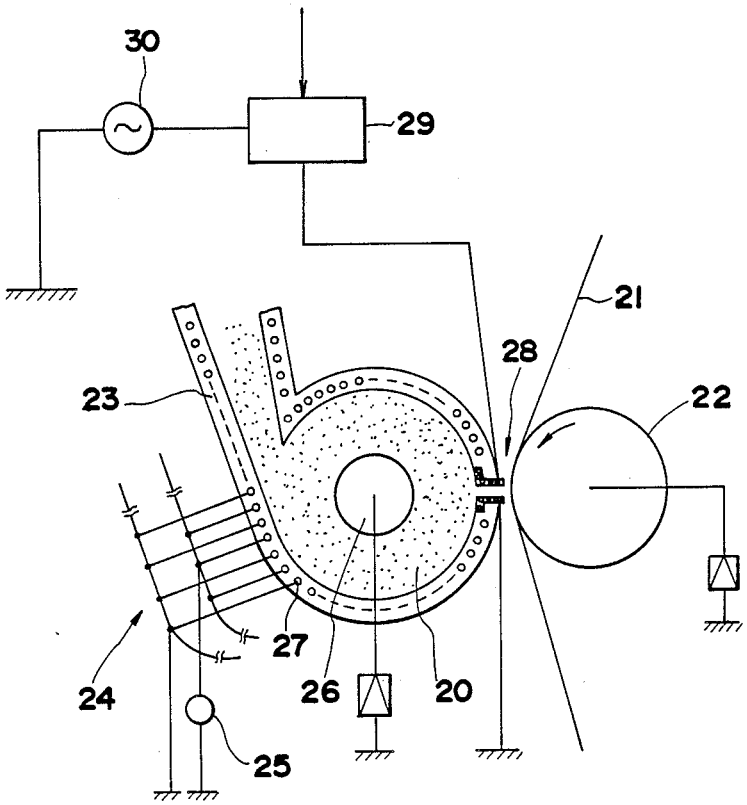
FIG. 8 is a side elevation view showing a schematic view of a portion of the developing apparatus of another embodiment of the present invention in cross section.

FIG. 8 shows another embodiment of the present invention.

Developer 20 used in the present embodiment is identical to that used in the First Embodiment. The material of recording medium 21 and bias roller 22, and the bias voltage applied to said roller 22 are identical to those described in the First Embodiment. The developing gap was set at 500 μm.

Developing chamber 23 is cylindrical in shape, as shown in the drawing, and formed of acrylic resin. A first electrostatic curtain generating means 24 is disposed beneath the entire circumference of the cylinder, and is capable of effectively charging and suspending developer 20. First electrostatic curtain generating means 24 comprises a plurality of Al leads 27 laid in parallel in the longitudinal direction of developing chamber 23, and AC power source 25. The impressed AC voltage is 250 V at a frequency of 1.2 kHz. Developing chamber 23 has provided therein an aluminum bias electrode 26 to which is applied a −250 V DC voltage. Developer 20 can be effectively charged and suspended by means of the aforesaid bias electrode.

To confine or release the charged and suspended developer, a second electrostatic curtain generating means 28 and gate circuit 29 for controlling said second generating means are provided and operate in substantially the same manner as those described in the First Embodiment. The AC voltage supplied by AC power source 30 is 250 V at a frequency of 1 kHz.

Third Embodiment

Figure 9:
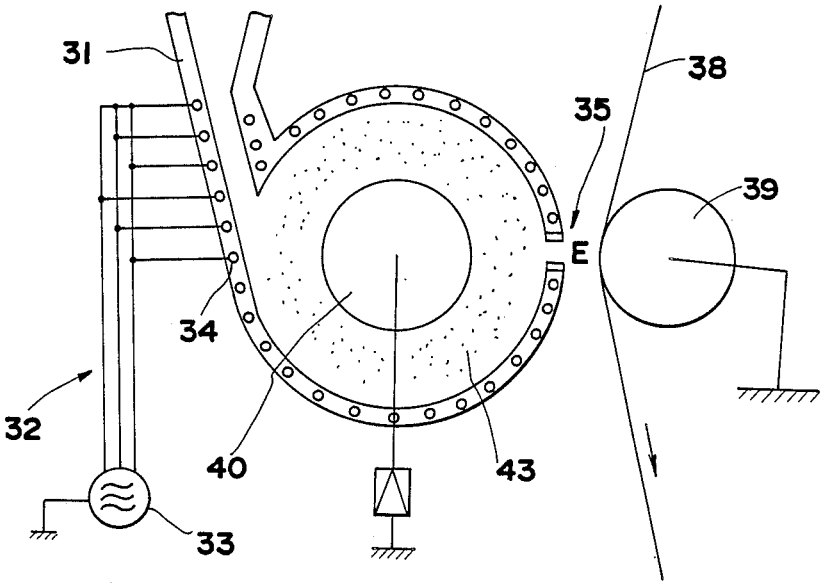
FIG. 9 is a side elevation view showing a schematic view of a portion of the developing apparatus of still another embodiment of the present invention in cross section.

FIG. 9 shows another embodiment of the invention.

In the present embodiment, developing chamber 31 has a cylindrical configuration similar to that in the Second Embodiment, and the bias voltage electrode 40, to which is impresses +250 V, is also similarly provided. First electrostatic curtain generating means 32 comprises a three-phase AC power source 33 and aluminum linear electrodes 34 arranged in parallel longitudinally in developing chamber 31. Developing chamber 31 is formed of polyester resin.

The developer 43 used in the present embodiment is a capsule toner-type developer comprising an ink component containing polyester resin and coated by a film of polyurethane resin. The developer particles are formed so as to have a total particle diameter of 10 μm and the resin film has a thickness of 1.0 μm.

The second electrostatic curtain generating means 35 provided at slit opening E comprises a three-phase AC power source 36, gate circuit 37, primary electrodes "ei" and secondary electrodes "fi."

The material of recording medium 38 is identical to that used in the First Embodiment. Roller 39 is disposed so as to simply maintain the space, i.e. the proper developing gap, between recording medium 38 and developing chamber 31, and a bias voltage is not applied thereto.

In the present embodiment, developer particles may be made to actively fly onto recording medium 38 because the electrostatic curtain generated by the second electrostatic curtain generating means 35 operates as a progressive wave. A detailed explanation of the aforesaid occurrence follows hereinafter.

Figure 10:
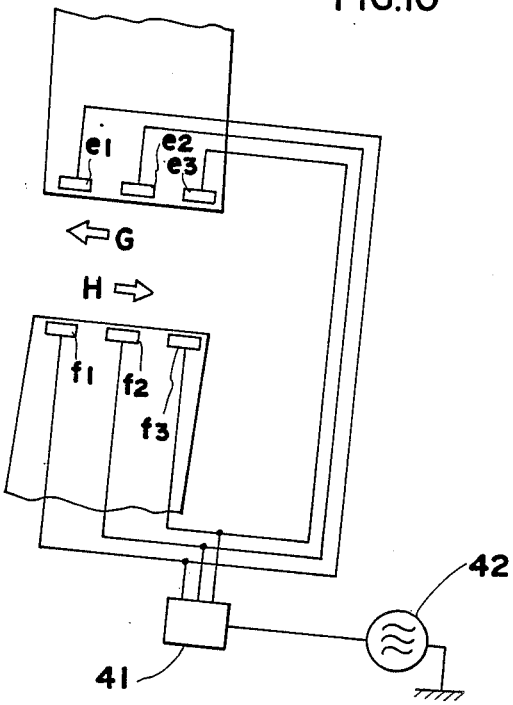
FIG. 10 is an enlarged partial section view illustrating the operation of the second electrical field curtain generating means of the apparatus shown in FIG. 9.

FIG. 10 is a partial enlargement of the second electrostatic curtain generating means 35. Primary electrodes "ei" and secondary electrodes "fi" have a progressive wave electrostatic curtain is produced and interposed therebetween based on signals transmitted from gate circuit 41 which is connected to a host computer or the like not shown in the drawing. The direction of the aforesaid progressive wave is pre-fixed in the direction indicated by arrow G when it is desirable for developer particles to fly to the recording medium, and in the arrow H direction when said developer particles are not desired to fly.

The operation of gate circuit 41 is substantially similar to that described in FIGS. 6 and 7. In the present embodiment, image formation is not accomplished by switching the AC voltage ON and OFF, but rather differs from previous embodiments only in that image formation is accomplished by reversing the direction of the progressive wave.

That is, gate circuit 16 in the First Embodiment controls the AC voltage so as to switch OFF the AC voltage when developer particles were made to adhere to the recording medium, and switch ON when said developer particles were to be confined. However, gate circuit 41 in the present embodiment controls the direction of the progressive wave electrostatic curtain so as to make said wave travel in the G arrow direction when developer particles are intended to adhere to the recording medium, and travel in the H arrow direction when said particles are to be confined.

The AC voltage output by three-phase AC power source 42 is a square-wave three-phase AC voltage of 1.2 kV at a frequency of 1 kHz. AC voltages of from 100 V to 5 kV at frequencies of 100 Hz to 10 kHz are suitable to accomplish the objects of the present invention.

Developer particle adhesion is adequately accomplished without providing a bias power source behind recording medium 38 and gradation reproducibility is achieved by using second electrostatic curtain generating means 35 as the progressive wave electrostatic curtain generating means.

Fourth Embodiment

Figure 11:
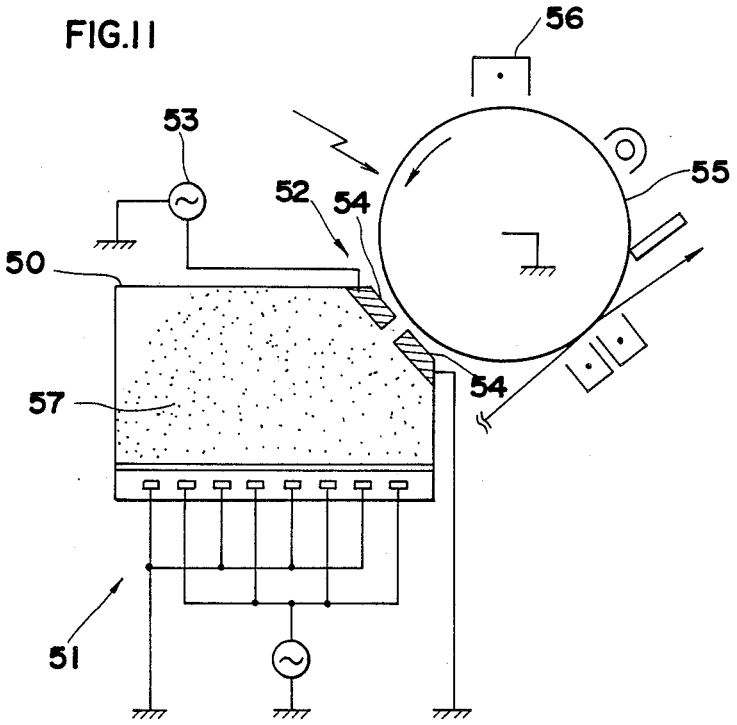
FIGS. 11 and 12 are side elevation views showing schematic views of a portion of the developing apparatus of still other embodiments of the present invention in cross section.

FIG. 11 shows another embodiment of a developing device using the present invention installed in an electrophotographic copy machine which forms an electrostatic latent image on a recording medium, and using a powder toner, forms a toner image on said recording medium. Developing chamber 50 and first electrostatic curtain generating means 51 are identical to those used in the First Embodiment. Further, the toner presently used is a negative-charging, non-magnetic monocomponent toner identical to that used in the First Embodiment, and the toner charging and suspension principles are also the same those described in the First Embodiment.

The second electrostatic curtain generating means 52 provided at the opening of developing chamber 50 comprises a slit electrode 54 connected to AC power source 53. The space (developing gap) between said slit electrode 54 and recording medium 55 is set at 0.5 μm.

Electrostatic latent image formation is accomplished based on the so-called electrophotographic method by inducing a surface potential $V_o$ of +600 V on a P-type Se-Te photosensitive member used as the recording medium 55 via sensitizing charger 56, and exposing thereon an image using an optical system (not shown in the drawing). Slit electrode 54 has an AC voltage of 250 V at a frequency of 2 kHz applied thereto from AC power source 53. When an electrostatic latent image is not formed on the recording medium 55, the charged and suspended toner cloud 57 is confined within developing chamber 50 by the force of the electrostatic curtain generated by slit electrode 54. On the other hand, when an electrostatic latent image is formed on recording medium 55, the electric field produced by the +600 V surface potential of the recording medium 55, which has the opposite polarity of the toner on the recording medium, overcomes the force of the aforesaid electrostatic curtain, and a portion of the cloud-like charged and suspended toner 57 is released from said cloud. The aforesaid charged and suspended toner cloud 57 is electrostatically attracted to the charge on recording medium 55 and a toner image is formed thereon, thereby developing the latent image.

Fifth Embodiment

Figure 12:
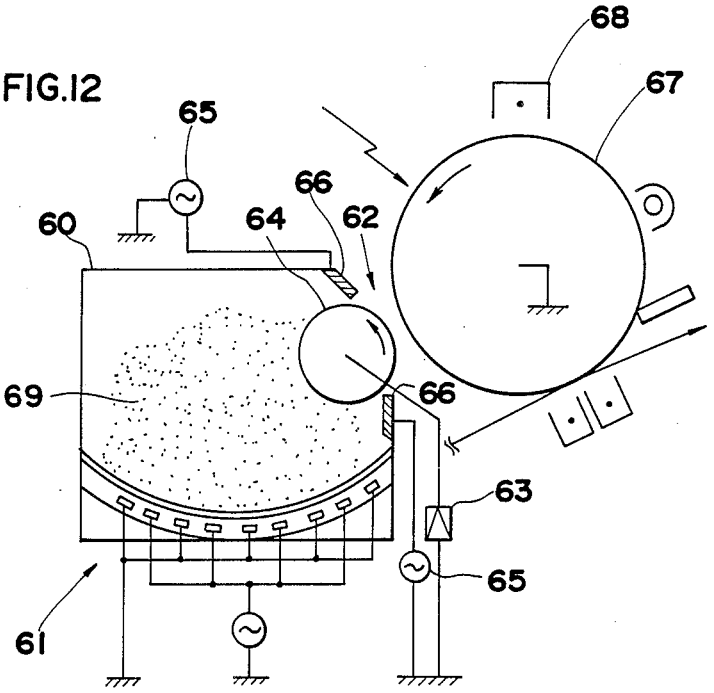

FIG. 12 shows another embodiment of the developing apparatus using the invention installed in an electrophotographic copy machine which forms an electrostatic latent image on a recording medium and uses a powder toner to form a toner image thereon.

Developing chamber 60 and first electrostatic curtain generating means 61 are substantially identical to those used in the First Embodiment. First electrostatic curtain generating means 61 has its upper surface formed in a concave configuration to effectively accomplish toner charging and suspension Further, the toner presently used is the same negative-charging, non-magnetic monocomponent toner described in the First Embodiment, and the principles of toner charging and suspension are also identical to those of said First Embodiment. Second electrostatic curtain generating means 62 uses an aluminum electrode roller 64 connected to a DC bias power source 63 provided at the opening of developing chamber 60, and slit electrode 66 connected to AC power source 65, recording medium 67 and sensitizing charger 68 which are identical to those described in the Third Embodiment. After the recording medium 67 is charged with a surface potential $V_o$ of +600 V, an electrostatic latent image is formed thereon in the same manner as described in the Fourth Embodiment.

Electrode roller 64 usually has a +250 V DC vias voltage applied thereto from DC vias power source 63, and is then rotated at a specific speed in the arrow direction by a drive mechanism (not shown in the drawing). The charged and suspended toner cloud 69 within developing chamber 60 is maintained above electrode roller 64 to negatively charge said toner.

When an electrostatic latent image is not formed on the recording medium 67, the charged and suspended toner is confined by the force of the electrostatic curtain produced by slit electrode 66 via the AC voltage of 250 V at a frequency of 2 kHz applied thereto by AC power source 65. On the other hand, when an electrostatic latent image is formed on the recording medium 67, a portion of the charged and suspended toner 69 within developing chamber 60 is released from the cloud and electrostatically attracted to the charge on recording medium 67, and a toner image is formed therein, thereby developing said latent image.

Although embodiments 1 through 4 used a monocomponent developer, developer incorporating both toner particles and carrier particles may be used. Further, silica or other flow agents, as well as other additives may be incorporated in the developer.

For more detailed information on concerning the technology of the "electrostatic curtain," please consult "Charged particle cloud prevention, confinement and transport via electrostatic curtain" by T. Masuda et al., published in Transactions of the Institute of Electrical Engineers of Japan, Vol.92-B, No. 1, pp.9–19, Issue No. 47-B2.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus for forming a developing powder image onto a recording medium comprising:

a chamber for accommodating a developing powder and having an opening confronting the recording medium;

first electric field generating means for generating an electric field curtain force in the chamber so as to suspend the developing powder in a cloud, whereby said suspended developing powder is charged;

second electric field generating means for generating an electric field curtain force which is variable so as to selectively move the suspended developing powder onto the surface for the recording medium, said second electric field generating means being provided in the vicinity of the opening; and controlling means for controlling the intensity of the electric field being generating by the second electric field generating means according to an image signal so as to selectively move the suspended developing powder onto the surface of the recording medium.

2. An image forming apparatus as claimed in claim 1, wherein an internal wall of the chamber is made from material which has a triboelectric charging characteristic opposite to the developing powder thereby causing said developing powder to be charged by contacting the internal wall.

3. An image forming apparatus as claimed in claim 1, wherein an internal wall of the chamber is cylindrically shaped to circulate the developing powder by electric field curtain force being generated by the first electric field generating means.

4. An image forming apparatus as claimed in claim 1, further comprising an electrode provided in the chamber, wherein a space is formed between the internal wall of the chamber and said electrode.

5. An image forming apparatus as claimed in claim 3, wherein the type of electric field curtain force being generated by the first electric field generating means is a progressive wave electric field curtain force.

6. An image forming apparatus for forming a developing powder image onto a recording medium comprising:

a chamber for accommodating a developing powder and having an opening confronting the recording medium;

first electric field generating means for generating an electric field curtain force in the chamber so as to suspend the developing powder in a cloud, whereby said suspended developing powder is charged;

second electric field generating means for generating a progressive wave electric field curtain force which is variable in the direction perpendicular to the recording medium so as to selectively move the suspended developing powder onto the surface of the recording medium, said second electric field generating means being provided in the vicinicty of the opening; and controlling means for controlling the direction of the progressive wave electric field curtain force according to an image signal so as to selectively move the suspended developing powder onto the surface of the recording medium.

7. An image forming apparatus as claimed in claim 6, wherein an internal wall of the chamber is made from material which has a triobolectric charging characteristic opposite to the developing power, thereby causing said developing powder to be charged by contacting the internal wall.

8. An image forming apparatus as claimed in claim 6, wherein an internal wall of the chamber is cylindrically shaped to circulate the developing powder by the electric field curtain force being generated by the first electric field generating means.

9. An image forming apparatus as claimed in claim 6, further comprising an electrode provided in the chamber, wherein a space is formed between the internal wall of the chamber and said electrode.

10. An image forming apparatus as claimed in claim 8, wherein the type of electric field curtain force being generated by the first electric generating means is a progressive wave electric field curtain force.

* * * * *